US006682191B2

(12) United States Patent
Temple et al.

(10) Patent No.: US 6,682,191 B2
(45) Date of Patent: Jan. 27, 2004

(54) VACUUM DRUMS FOR PRINTING, AND DUPLEX PRINTERS

(75) Inventors: Stephen Temple, Science Park (GB); Keith P. Butler, Science Park (GB); Howard J. Manning, Science Park (GB); Michael J. Dixon, Science Park (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 10/219,230

(22) Filed: Aug. 15, 2002

(65) Prior Publication Data

US 2002/0191065 A1 Dec. 19, 2002

Related U.S. Application Data

(62) Division of application No. 09/515,435, filed on Feb. 29, 2000, now Pat. No. 6,460,991, which is a continuation of application No. PCT/GB98/02654, filed on Sep. 4, 1998.

(30) Foreign Application Priority Data

Sep. 4, 1997 (GB) ..... 9718843

(51) Int. Cl.[7] ..... B41J 2/01

(52) U.S. Cl. ..... 347/104; 271/276; 399/305; 400/627

(58) Field of Search ..... 399/305; 347/104; 400/627, 662; 271/276, 275, 194, 195, 183; 101/389.1, 232

(56) References Cited

U.S. PATENT DOCUMENTS

| | | | | |
|---|---|---|---|---|
| 4,015,522 | A | 4/1977 | Preuss et al. | 101/183 |
| 4,101,018 | A | 7/1978 | Sokolowski | 400/582 |
| 4,202,542 | A | 5/1980 | Lammers et al. | 271/276 |
| 4,272,181 | A | 6/1981 | Treseder | |
| 4,411,420 | A | 10/1983 | Louis et al. | 271/276 |
| 4,437,659 | A | 3/1984 | Caron et al. | 271/276 |
| 4,504,843 | A | 3/1985 | Pröhl et al. | 346/138 |
| 4,568,073 | A | 2/1986 | VanHorne | 271/11 |
| 4,662,622 | A | 5/1987 | Wimmer et al. | 271/96 |
| 4,672,892 | A | 6/1987 | Ackley | 101/35 |
| 4,852,488 | A | 8/1989 | Abendroth et al. | 101/246 |
| 4,924,273 | A | 5/1990 | Joseph | 399/305 |
| 4,986,522 | A | 1/1991 | Paulson | 271/2 |
| 5,053,791 | A | 10/1991 | Baek et al. | 346/138 |
| 5,072,922 | A | 12/1991 | Paulson | 271/99 |
| 5,132,708 | A | 7/1992 | Schmidlin et al. | 347/55 |

(List continued on next page.)

FOREIGN PATENT DOCUMENTS

| | | |
|---|---|---|
| DE | 636079 | 10/1936 |
| JP | 56-23147 | 3/1981 |
| JP | 59-097925 | 6/1984 |
| JP | 63-22675 | * 1/1988 |

*Primary Examiner*—Susan S.Y. Lee
(74) *Attorney, Agent, or Firm*—Marshall, Gerstein & Borun LLP

(57) ABSTRACT

A vacuum drum assembly for a printing machine has a drum with an array of passageways distributed along its length and around its periphery. The passageways permit air to flow from outside the drum to inside the drum in response to reduced air pressure inside the drum. The assembly also has an array of valve members, each valve member being movable between a closed position in which that valve member restricts at least one of the passageways and an open position in which the restriction of that passageway or those passageways is reduced. The assembly is arranged such that, when a partial area of the drum is wrapped with a sheet of material, at least some of the valves for the passageways adjacent the edges of that area are open, and the valves for the passageways which are not covered by the sheet and are not adjacent the edges of that area are closed.

94 Claims, 7 Drawing Sheets

U.S. PATENT DOCUMENTS

| | | | | |
|---|---|---|---|---|
| 5,183,252 | A | | 2/1993 | Wolber et al. ..... 271/276 |
| 5,211,391 | A | | 5/1993 | Kerr et al. ..... 271/276 |
| 5,268,708 | A | | 12/1993 | Harshbarger et al. ..... 346/134 |
| 5,301,099 | A | | 4/1994 | Kerr ..... 346/138 |
| 5,341,159 | A | | 8/1994 | Kerr ..... 346/134 |
| 5,376,954 | A | | 12/1994 | Kerr ..... 346/138 |
| 5,383,001 | A | | 1/1995 | Bosy ..... 355/73 |
| 5,764,263 | A | | 6/1998 | Lin ..... 347/101 |
| 5,913,268 | A | | 6/1999 | Jackson et al. ..... 101/232 |
| 6,270,074 | B1 | | 8/2001 | Rasmussen et al. ..... 271/276 |
| 6,460,991 | B1 | * | 10/2002 | Temple et al. ..... 347/104 |

* cited by examiner

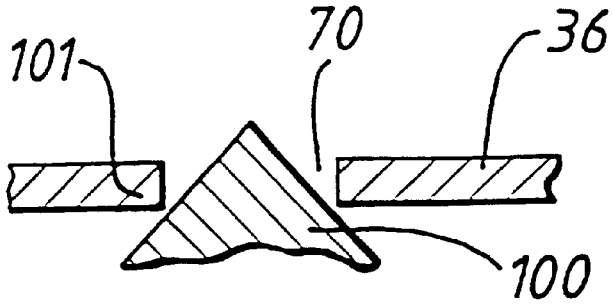
Fig. 12(a)
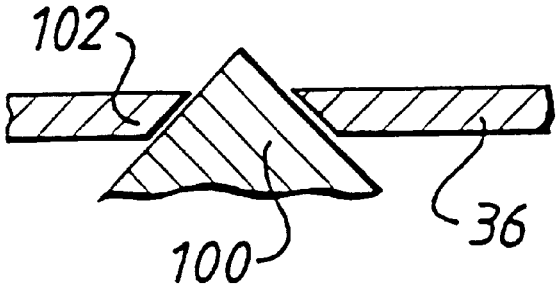
Fig. 12(b)
Fig. 13
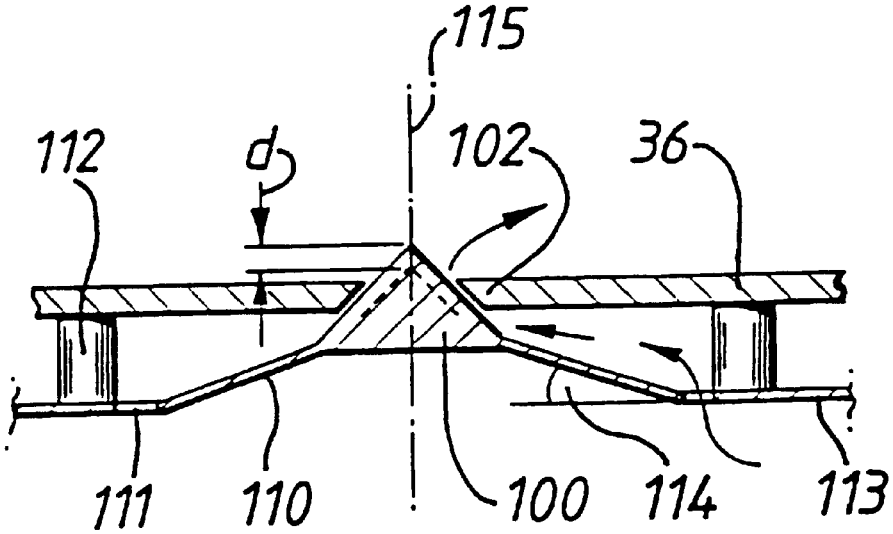

VACUUM DRUMS FOR PRINTING, AND DUPLEX PRINTERS

This is a divisional of application Ser. No. 09/515,435 filed Feb. 29, 2000 which is a continuation of Application No. PCT/GB98/02654 filed Sep. 4, 1998.

This invention relates to printing machines and to vacuum drum assemblies for printing machines, such as inkjet or laser printers.

It is known for the printing drum in a printing machine to employ a vacuum to hold the paper or other material down on the drum. Such a drum might have an array of holes or passageways distributed along its length and around its periphery to permit air to flow from outside the drum to inside the drum in response to reduced air pressure inside the drum. In operation, a new sheet is fed to the rotating drum by a sheet feeder, and the vacuum captures it and rolls it on to the drum. As the drum and paper rotate, the paper passes one or more print heads which are used to print on the paper with as many revolutions as is necessary. As soon as the leading edge of the paper passes the print head, or last print head, on its last pass, an ejector is used to remove the paper from the drum. As soon as the trailing edge of the paper has passed the sheet feeder, the next sheet of paper is fed.

A problem which arises with such an arrangement is that, before the first sheet is fed, all of the holes or passageways in the drum are open, and therefore there is a large flow of air through the holes or passageways into the drum. Once a sheet is wrapped around the drum, some or all of the drum surface is closed, and a much lower flow of air is required. Particularly at the leading and trailing edges of the paper, its stiffness works against the vacuum. If a low density of suction holes is provided, these edges may then be released inadvertently. Accordingly, the total area of the holes or passageways needs to be as large as possible. However, a large area means that, in the case where no paper is loaded, a large volume flow is required to achieve a sufficient pressure differential. This requires a large fan, is noisy, and produces a loud slapping noise when paper is fed. There is also the related problem that the maximum flow obtainable may be determined primarily by the relatively smaller flow area presented by the end of the drum. Much of the power of the fan is dissipated in overcoming the pressure loss through this section, rather than producing a useful pressure differential at the drum surface.

In accordance with a first aspect of the present invention, there is provided a vacuum drum assembly for a printing machine, comprising:

a drum having an array of passageways distributed along its length and around its periphery to permit air flow from outside the drum to inside the drum in response to reduced air pressure inside the drum, and an array of valve members, each valve member being moveable between a closed position in which that valve member restricts at least one of the passageways and an open position in which the restriction of the at least one passageway is reduced;

the arrangement being such that, when a partial area of the drum is wrapped with material to be printed, at least some of the valves for the passageways adjacent an edge of that area are open, and the valves for the passageways which are not covered by the material and are not adjacent an edge of that area are closed.

A said valve member may be normally closed and may be opened by a pressure difference, for example between adjacent passageways.

In one embodiment, each passageway is provided with a respective such valve member. Each passageway could then be provided with a sensor for detecting, for example, the air pressure in that passageway upstream of the valve, or the air flow rate through the passageway, and the valve could be opened and closed in dependence upon the output of the sensor. Although possible, this would be a complicated arrangement.

In another embodiment, each of the valve members affects an adjacent pair of the passageways. In this case, the valve can be opened and closed automatically as a result of an imbalance or a balance of the pressures in the pair of passageways.

A particularly elegant and easily manufactured arrangement is possible when there are wall portions between adjacent pairs of the passageways, and each valve member comprises a butterfly valve pivotally mounted on a respective one of the wall portions and biased towards its closed position.

The term "pivotally mounted" is not intended to be limited to pin-jointed structure. It includes also arrangements in which the butterfly valve can tilt or rock about its (usually central) portion whereat it is attached to the wall portion.

In accordance with a further embodiment of the invention, each passageway is provided with a valve member which may be opened by mechanical actuation; for example, the valve member may include actuating means which moves the valve member to the open position on mechanical contact with the material to be printed. In a preferred form of this embodiment, the actuating means comprises a portion of the valve member which is housed within the passageway and is dimensioned to be proud of the drum when the valve member is in the closed position so that, in service, the material to be printed, as it is fed to the drum, urges the actuating means into the passageway thereby moving the valve member to the open position.

Preferably, the valve member is biased, suitably by resilient means, so that on removal of the material it moves back to the closed position. Alternatively, the valve member may be bistable; that is it may be biased towards closed when close to the closed position (thereby achieving good sealing) and also biased towards open when close to the open position: this is particularly useful for valve members near the edge of the material to be printed. A particular advantage of using a bistable valve in this context is that it ensures a fully open valve proximate the edge of the material to be printed. This is desirable since partial actuation of a valve (which might otherwise occur) may give rise to imperfect retention.

The resilient means used to bias may have a non-linear response.

Such an embodiment (unlike the above-mentioned embodiment wherein each valve member comprises a butterfly valve pivotally mounted on one of the wall portions and biased to its closed position) ensures that all such valve members remain in the open position until the removal of the material from mechanical contact with the actuating means; the material is thus held to the drum more definitely which facilitates print definition, particularly in multiple pass printing.

Each passageway may have a circular, annular, elliptic or polygonal, suitably a regular polygonal, cross-section and the passageways may be arranged as a tessellation. The cross-section of each passageway is preferably square, although other cross-sectional shapes may be employed, such as triangular and hexagonal.

The tessellation may be such as to provide rows of passageways generally parallel to the drum axis. It is preferred, however, that the rows are skew to the drum axis; this will ensure that the leading and trailing edges of the material to be printed fall at least on some valves, thereby facilitating its capture.

The curvature of the external surface of the drum about each passageway may be uniform; however, the external surface of the drum about each passage way may be flat or afford a spherical or cylindrical depression about the passageway, thereby increasing the area over which the vacuum from each passageway can act on the material to be printed and again facilitating its capture and retention.

There may be means for damping movement of the valve members. Thus the wall portions may be of energy-absorbing material and may be connected to the butterfly valves to effect said damping.

In a further embodiment, there is provided material stripping means positioned within the drum and actuatable to be urged into contact with the inside of the drum wall thereby moving all contacted valve members from the open position to the closed position. Preferably the stripping means is parallel with the drum axis and, suitably, coextensive with the length of the drum. In a preferred form of the embodiment the stripping means comprises a non-driven, but rotatable, cylinder and is suitably mounted at a station where the leading edge of the printed material is, after its final pass, required to be stripped.

In accordance with a second aspect of the present invention, there is provided a printing machine, including a vacuum drum assembly according to the first aspect of the invention.

A third aspect of the present invention is concerned with duplex printing machines, that is machines which can print on both sides of a sheet of material. It is known to provide inkjet and laser printers with a duplexing facility, for example by printing on one side of the material and then reversing the direction of feeding of the material and diverting its path so that it returns to the printing position effectively turned over.

In the accordance with a third aspect of the present invention, there is provided a duplex printing machine comprising: first and second vacuum drum assemblies each in accordance with the first aspect of the invention and with their drums parallel; means for reducing the air pressure inside the drums; means for counter-rotating the drums; means for feeding a sheet of material to be printed on to the first drum so that the material can be held on the first drum by vacuum and rotated therewith; first printing means for printing on the material on the first drum; means for releasing the material from the first drum in a direction towards the second drum so that the material can be held on the second drum by vacuum and rotated therewith; second printing means for printing on the material on the second drum; and means for releasing the material from the second drum. Although such a machine uses two drums and two printing means, it provides a very neat and compact arrangement.

Since the vacuum drum assemblies as described above will have less of a tendency violently to grab the leading edge of the material being fed onto them, the machines of the second and third aspects of the invention preferably further include, for the or each drum, means for holding or directing the material against or towards the or the respective drum at the position in which the material is fed on to the, or the respective, drum. These means may for example be a pinch roller or guide.

This roller or guide optionally may press intermittently on to the drum, eg. only when a sheet of material is being fed on to the drum, and then withdraw. This will reduce any tendency for the roller or guide to offset (transfer) still-wet ink from the sheet onto another portion thereof, or on to a subsequent sheet.

The duplex configuration of drums may be provided independently of the first aspect of the invention. Therefore, in accordance with a fourth aspect of the present invention, there is provided a duplex printing machine comprising: first and second parallel drums; means for counter-rotating the drums; means for feeding a sheet of material to be printed on to the first drum; means for holding the fed material on the first drum; first printing means for printing on the material on the first drum; means for releasing the material from the first drum in a direction towards the second drum; means for holding the fed material on the second drum so as to be rotated therewith; second printing means for printing on the material on the second drum; and means for releasing the material from the second drum.

In one embodiment, the direction in which the material is released from the first drum towards the second drum is generally parallel to and opposite to the direction in which the material is fed onto the first drum; and the direction in which the material is released from the second drum is generally parallel to and opposite to the direction in which the material is fed onto the second drum. Said directions may be generally horizontal, if the sheets are stacked horizontally or vertical if the sheets are stacked vertically.

Specific embodiments of the present invention will now be described, purely by a way of example, with reference to the accompanying drawings, in which.

Figure 9A:
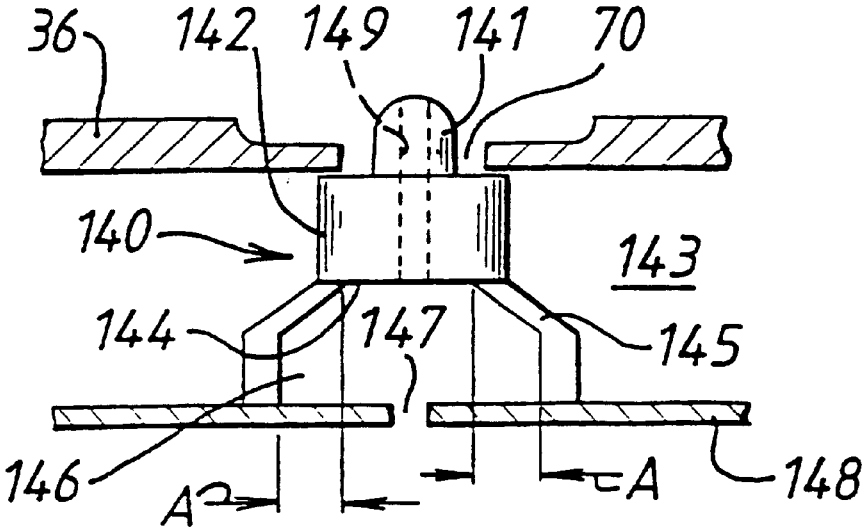
Figure 9B:
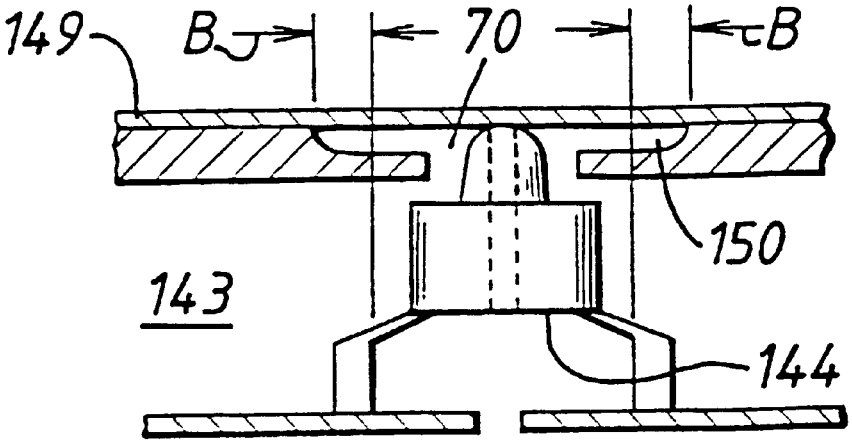

FIGS. 9(*a*) and (*b*) are schematic cross-sectional views of a yet further embodiment of arrangement of valve members.

Figure 6:
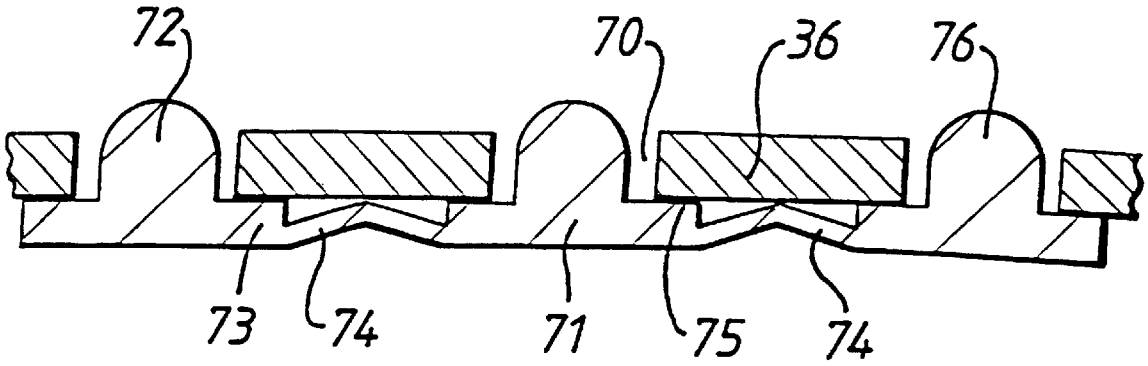
FIG. 6 is a schematic cross-sectional view through the wall of the drum showing a further embodiment of arrangement of valve members.
Figure 10:
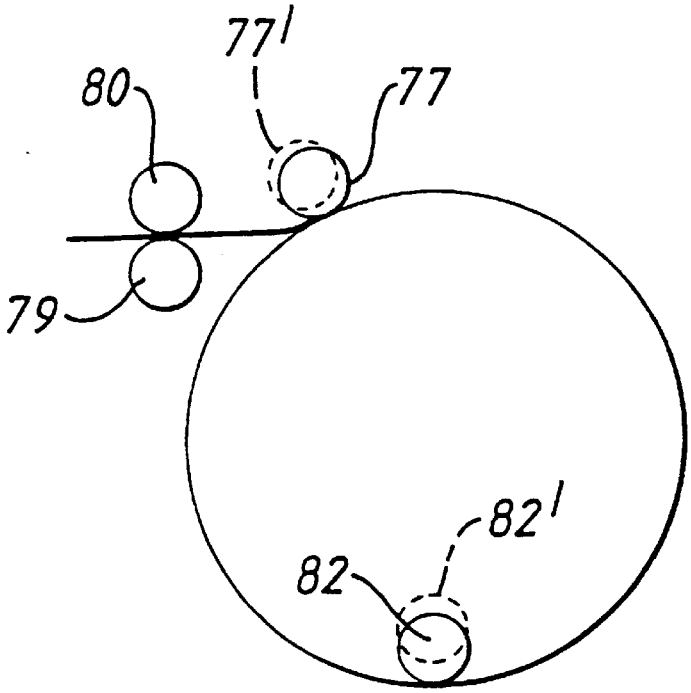
Figure 11:
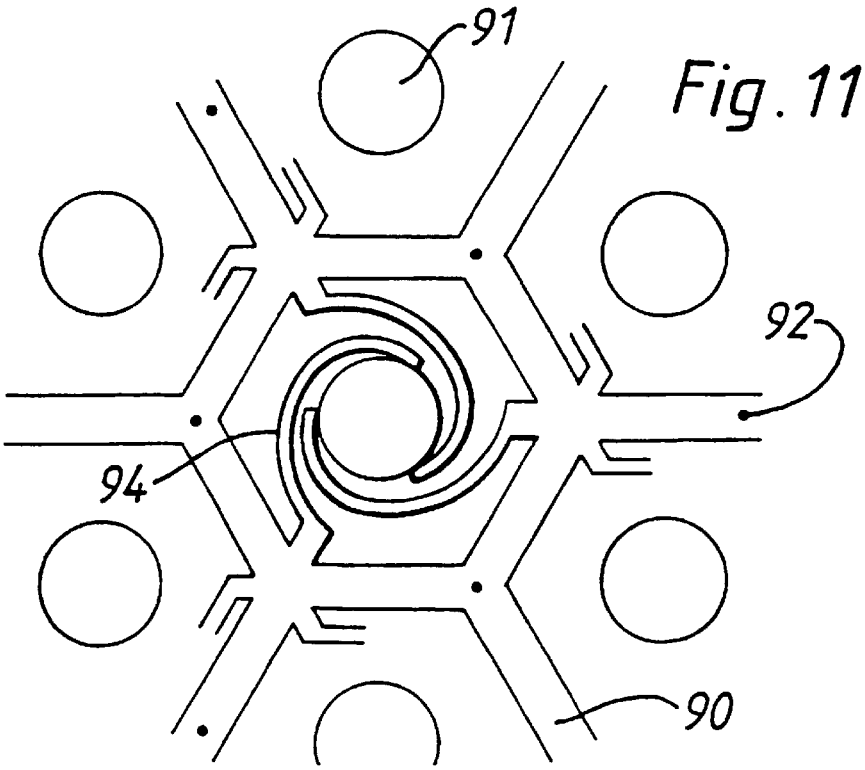

FIG. 10 is a schematic cross-sectioned view showing an internally located strip roller; and FIG. 11 is a schematic plan, looking radially inward from the drum wall similar to that depicted in FIG. 6 of a embodiment but in which the valves are retained in a matrix.

FIGS. 12(*a*) and (*b*) are schematic cross-sectional views of an alternative design of the male valve of the embodiment of FIG. 6.

FIG. 13 is a schematic cross-sectional view of a modification of the valve of FIG. 12.

Figure 14:
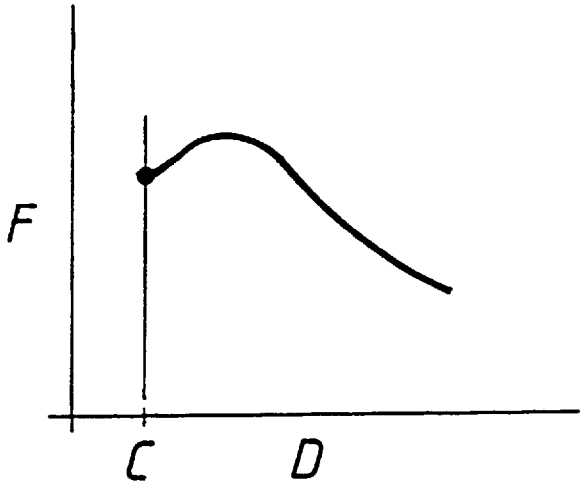

FIG. 14 is a graph representing the variation of the resistance F to deplacement d of the valve of FIG. 13 relative to inward deplacement d.

Figure 15:
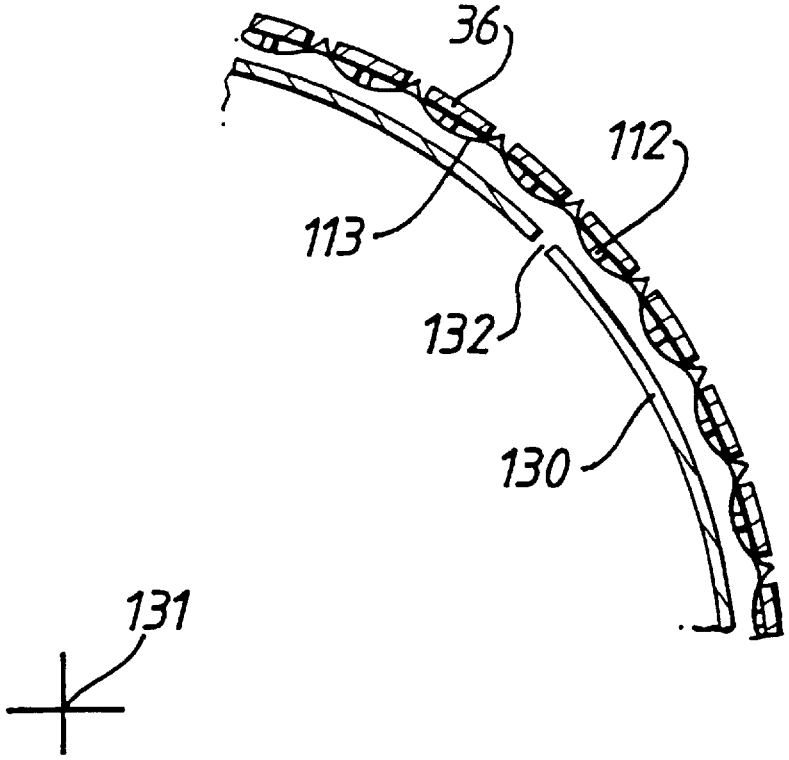

FIG. 15 is a schematic cross-sectional view of a section of a vacuum drum incorporating the valve element of FIG. 11.

Figure 1:
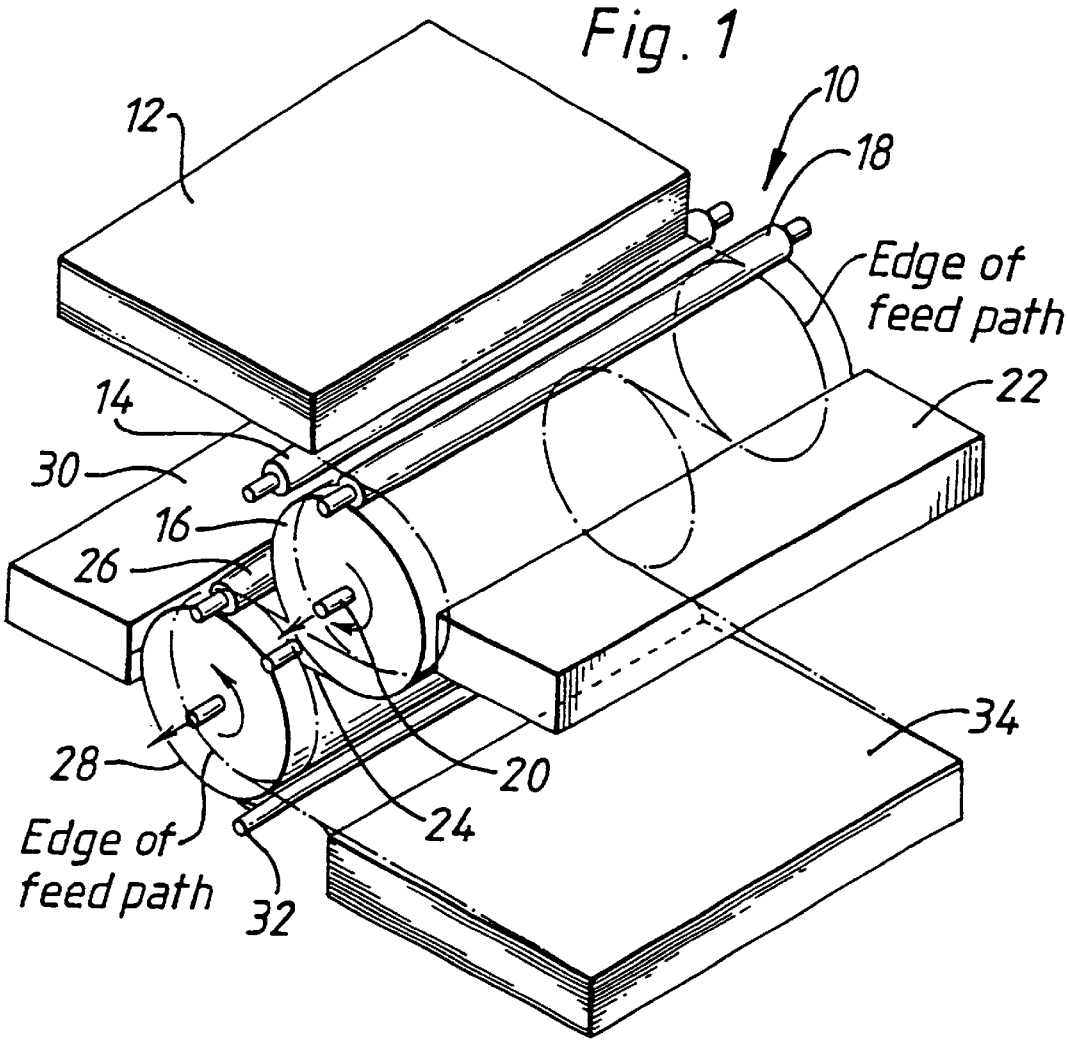
FIG. 1 is a schematic isometric view of a duplex printing machine.

Referring to FIG. 1, a duplex printing machine 10 has a paper input tray for holding a stack 12 of fresh paper and a feed roller 14 which can be driven to feed the sheets of paper one at a time from the bottom of the stack 12 in a known fashion. The leading edge of the fed sheet of paper is directed horizontally into a nip between a first vacuum drum 16 and a pinch roller 18 vertically above the first vacuum drum 16. Air is drawn from the first vacuum drum 16 through its shaft 20 and the reduced air pressure in the drum 16 holds the paper to the drum as the drum rotates in the direction shown by the arrow in FIG. 1. A first inkjet print head 22 (of a type known per se) is disposed 90° downstream from the pinch roller 18 around the axis of the drum 16. In operation, the drum 16 is rotated with the sheet held to the drum for as many revolutions as necessary for the inkjet head 22 to print the required information on the sheet. There may for example be four passes for four-colour printing using a page wide print head, or there may be multiple passes if the active width of the print head is less than the width of the sheet to be printed, the print head then being indexed as known per se between passes or groups of passes. An ejector 24 (known per se) disposed beneath the first vacuum drum 16 is then operated to lift the leading edge of the sheet from the drum 16 so that the leading edge is fed in a horizontal direction, opposite to the direction in which the sheet was originally fed from the stack 12.

The pinch roller 18 is withdrawn from contact with the drum 16 by mechanism not shown shortly after the trailing edge of the fed sheet has passed on to the drum, and before the leading edge arrives back at the pinch roller for the first time as the drum rotates. The pinch roller thus does not contact the freshly-printed surface of the sheet and any tendency for ink to be picked-up by the surface of the pinch roller and transferred to another part of the sheet or to a subsequent sheet (as in offset printing) is avoided.

A similar arrangement to that described above is provided to receive the sheet fed from the first vacuum drum 16, namely a second withdrawable pinch roller 26, a second vacuum drum 28 which rotates in the opposite direction to the first vacuum drum 16, a second inkjet print head 28, and a second ejector 32. In operation, the second vacuum drum 28 is rotated with the sheet held to the drum for as many revolutions as necessary for the second inkjet head 30 to print the required information on the other side of the sheet. Then, when the second ejector 32 is operated, the leading edge of the sheet is lifted from the drum 28 so that the leading edge is fed in a horizontal direction, opposite to the direction in which the sheet was originally fed onto the second vacuum drum 28, towards an output tray which holds a stack 34 of the printed sheets.

As an alternative to the pinch rollers 18, 26 there may be provided respective guides each in the form of an enclosed chute formed eg. of sheet material or plastics and terminating in an elongated slot extending across the drum. The chute is shaped to deliver the fed sheet close to and at a small angle to the surface of the drum so that its leading edge is promptly captured by the vacuum.

It will be appreciated from the above description that a compact arrangement is provided. The bulky items are the input paper stack 12, the output paper stack 34, the first and second inkjet print heads 22, 30 and the first and second vacuum drums 16, 28. The input paper stack 12 is disposed above the second vacuum drum 28 and the second inkjet print head 30, and has a short feed path to the first vacuum drum 16. The output paper stack 34 is disposed below the first vacuum drum 16 and the first inkjet print head 22, and has a short feed path from the second vacuum drum 28. Furthermore, the feed path between the first and second vacuum drums 16, 28 is also short.

The cylindrical walls 36 of the vacuum drums 16, 28 will now the described in more detail with reference to FIGS. 2 to 5. In these drawings, the curvature of the cylindrical wall has, for simplicity, not been shown.

Each drum wall 36 comprises a shell having a honeycomb arrangement of walls 38 which form an array of radial passageways 40 between the outside to the inside of the drum. The outer surface of the shell is covered with a cylindrical outer plate 42 which is perforated with an array of holes 44 having a finer pitch than the pitch of the walls 38. In use, the sheet 46 of paper is held against the outer surface of the outer plate 42.

Figure 2:
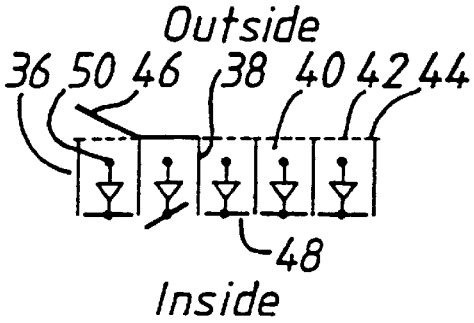
FIGS. 2 and 3 are schematic cross-sectional views through the wall of the drum showing two embodiments of arrangement of valve members.

In one embodiment, shown in FIG. 2, each passageway 40 has a respective leaky butterfly valve 48 and a respective air pressure sensor 50 upstream of the valve 48 in the passageway 40. A mechanical or electrical arrangement connects each sensor 50 to its butterfly valve 48 so that when the air pressure detected by the sensor 50 is relatively high the butterfly valve 48 is closed, and when the detected air pressure is relatively low the butterfly valve 48 is open. Accordingly, if the passageway 40 is not blocked by a sheet 46 of paper, the detected air pressure will be only slightly below atmospheric pressure, and the butterfly valve 48 will be closed. However, if the passageway 40 is blocked by the sheet 46 of paper, the detected air pressure will approximate to the significantly lower pressure inside the drum 16/28, and the butterfly valve 48 will be open.

Figure 3:
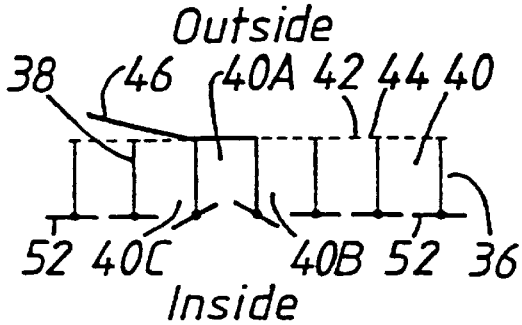

Another embodiment is shown in FIG. 3, which has some similarity to FIG. 2. However, instead of a respective leaky butterfly valve 48 for each passageway 40, in FIG. 3 leaky butterfly valves 52 are mounted centrally at the radially-inner edges of the honeycomb forming walls 38. If the cross-section of each passageway 40 in the honeycomb arrangement is square, then each passageway 40 shares four of the butterfly valves 52 with its adjacent passageways 40. The butterfly valves 52 are biased so that they are normally in their closed positions. In FIG. 3, one of the passageways 40A is shown completely (or almost completely) blocked by the sheet 46 of paper. The passageway 40B to the right of that passageway 40A is partly blocked by the leading edge of the sheet 46 of paper, and the passageway 40C to the left is not blocked, since the sheet 46 is still being fed onto the drum 16/28. The air pressures on the butterfly valve 52 between the passageways 40A and 40C are not balanced, so that butterfly valve twists anticlockwise so as to reduce the pressure in the passageway 40C and also in the passageway 40A. Also, because the passageway 40B is only partly blocked, the air pressures on the butterfly valve 52 between the passageways 40A and 40B are also not balanced, so that butterfly valve twists clockwise so as to reduce the pressure in the passageway 40B to provide a greater effect in holding down the leading edge of the sheet 46 of paper. Although not shown in FIG. 3, the butterfly valves 52 mounted on the wall 38 to the right of the passageway 40B and on the wall 38 to the left of the passageways 40C may also twist slightly. Indeed computer modelling of the apparatus suggests that superior results are achieved if this is the case.

From the above, it will be appreciated that, with the embodiment of FIG. 3, if a sheet 46 is not present on the drum 16/28, then all of the butterfly valves 52 will be in their closed positions so that only a slight reduction in pressure occurs at the surface of the drum 16/28 due to the leakiness of the butterfly valves 52, and so that an unnecessarily high air flow rate is avoided. When the sheet 46 is being fed onto the drum 16/28, an increased vacuum is applied at the edges of the area covered by the sheet 46. When the sheet 46 is fully loaded onto the drum 16/28, then it is held down by increased vacuum at the edges of the sheet 46. However, at areas of the drum 16/28 away from the edges of the sheet 46, whether covered by the sheet 46 or not, the butterfly valves 52 are in their closed positions, so that only a reduced vacuum is applied and so that there is not an unnecessarily high air flow in the regions not covered by the sheet 46.

Figure 4:
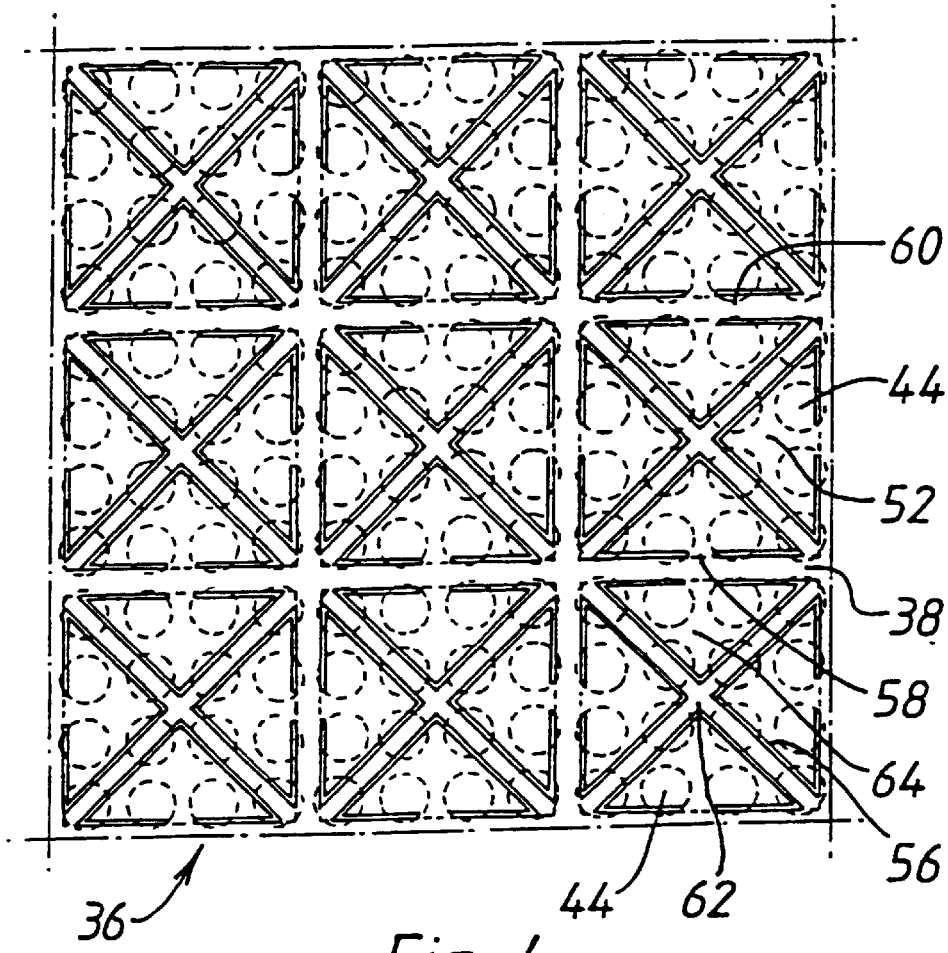
FIG. 4 is a view from within the drum of second embodiment looking outwardly.
Figure 5:
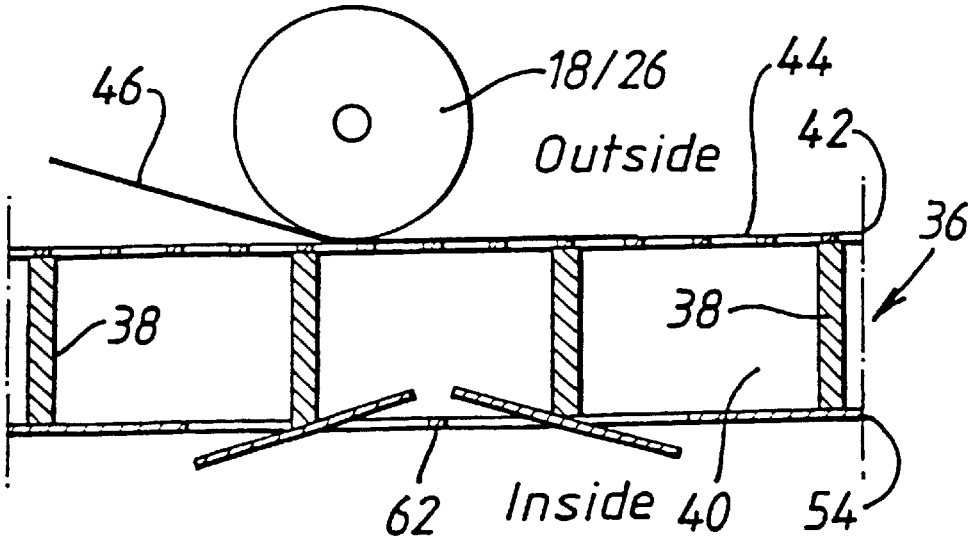
FIG. 5 is a cross-sectional view through the drum of FIG. 4.

More detail of the construction of the embodiment of FIG. 3 will now be described with reference to FIGS. 4 and 5.

As mentioned above, each drum wall 36 comprises a shell having a honeycomb arrangement of walls 38 which form an array of radial passageways 40 between the outside and the inside of the drum 16/28. As shown particularly in FIG. 4, the passageways 40 have a square cross-section. The cylindrical outer plate 42, which is perforated with an array of holes 44, surrounds and is attached to the outer surface of the shell. All of the butterfly valves 52 are formed by a single cylindrical sheet 54 of a springy material. As shown particularly in FIG. 4, the sheet 54 is formed with an array of right-angled triangular slots 56, each of which has a break 58 in the slot halfway along the hypotenuse of the triangle. Between the hypotenuses of adjacent pairs of the triangular slots 56, portions 60 are formed which are aligned with the inner edges of the walls 38. Between the shorter sides of adjacent groups of four of the triangular slots 56, portions 62 are provided which form a cross across the passageways 40. Due to the springiness of the sheet 54, each of the portions 60 enables the two triangular flaps 64 to either side of it to move so as to form the butterfly valves 52.

Early studies suggest that a suitable material for the sheet 54 is a plastics material eg. a polyimide such as KAPTON (trade mark). Also it is beneficial for the butterfly valves to be highly damped, eg. so that they exhibit at least (and preferably greater than) critical damping. To achieve this the drum walls 38 may be made of, or at least faced with, sponge or foam rubber material. The butterfly valves are glued to this material along their hypotenuses. Thus when a valve is deflected from its closed position, that portion of the valve which moves inwards towards the centre of the drum expends energy by stretching the foam material to which it is attached, and the valve portion 64 which is deflected outwards from the drum (into a passageway 40) expends energy by compressing the foam material.

Having described two embodiments of the present invention, it will be appreciated that many modifications and developments may be made within the scope of the invention.

For example, a mechanism may be placed at the printer output that staples duplex-printed sheets together along a centre line and then folds the sheets along that centre line, thereby to form a brochure or booklet. Clearly, for this to work, the print data must be provided to the printer in such an order that the resulting pages of the booklet are themselves in the correct order.

Also, the vacuum drum technique may be applied, for example, to printers which do not have the duplexing function and may be applied to printers which do not employ the inkjet technique of printing.

More than one sheet may be fed on to the drum simultaneously side-by-side; printing sheets of different sizes, eg. for photographic prints of different sizes, can thus easily be accomplished in a single machine. Although described in the context of a sheet-fed printer, the vacuum drum may also be applicable to holding-down the edges of web material in continuous-web printing.

Also, although the vacuum drum has been illustrated as having passageways with a square cross-section, it should be noted that other shapes may be used, such as triangular, hexagonal and circular.

The print heads 22,30 may be of the single colour or multi-colour type, or a plurality of different coloured print heads may be used, angularly spaced around each drum.

Figure 7:
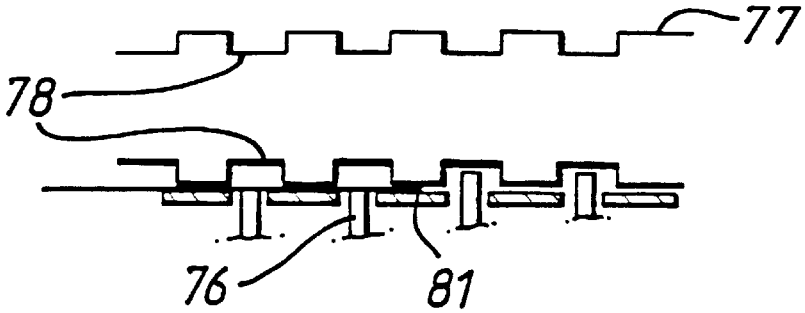
FIG. 7 is a schematic cross-sectioned view of the embodiment shown in FIG. 6 in service together with a grooved feed roller.

A further embodiment of the invention is shown in FIGS. 6 and 7. In this embodiment, the drum wall 36 simply comprises a metal sheet which is perforated with an array of holes 70 which, as depicted, are of circular cross-section although other cross-sections may be employed. Within the drum and in register with each such hole is an array of male valves 71, each of which comprises a chamfered, cylindrical collar 72 upstanding in the hole and integral with an annular shoulder 73. Instead of a cylindrical collar (as shown) it may be of conical cross-section; and the conical axis may be orthogonal with the passageway axis or not. The valves 71 are biased outwardly in fluid-tight relationship to the drum wall by wall-mounted spring elements 74 to form an annular seal 75 therewith while the collars 72 are dimensioned to be proud of the drum wall as a boss 76 when so biased.

Figure 8:
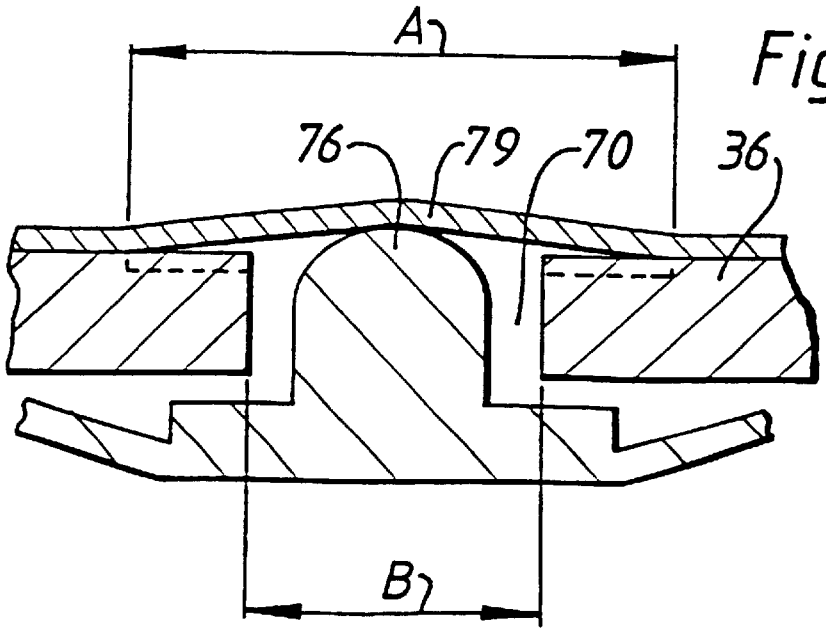
FIG. 8 is a schematic cross-sectional view of a part of the arrangement of FIG. 6 with a valve in the open position and overlaid with sheet material to be printed.

This embodiment may be utilised with feed roller 77, as shown in FIGS. 7 and 8. This roller has circumferential grooves 78 along its periphery and is mounted in parallel with the drum so that the grooves 78 mate with the bosses 76. The roller is withdrawable from contact with the drum to position $77^1$, for the reason previously mentioned in relation to pinch roller 18/26.

In use, sheet stock 79 (such as paper) to be printed is fed through the nip of guide rollers 80 and is urged by the feed roller 77 onto the drum. The rigidity of the sheet ensures that, as it is fed, it progressively depresses those bosses 76 with which it comes into contact; and that it spans the grooves 78 thereby maintaining the bosses 76 in the depressed position. The depression of the bosses opens the valves 71 against spring elements breaking seal 75; and these are maintained open by the action of the vacuum on the sheet 79 thereby creating a new seal between the paper and the drum wall 36.

FIG. 8 illustrates a valve member from FIG. 6 in its open position and with a sheet of material to be printed attached. As might be expected, sheet 79 does not lie flat on the surface of drum 36 but is displaced slightly by boss 76, allowing the vacuum to act not only over that area of the sheet lying directly over the hole 70 but over the greater area A shown in the figure. This is significantly larger than that area (shown as B in the figure) of the valve over which the vacuum acts when the valve is closed. The resulting greater pressure force acts on sheet 79, overcomes the bias applied by the spring elements 74 (FIG. 6) and holds the valve in its open position.

It will be appreciated that the degree of displacement of the paper and thus the area A will be determined by the paper characteristics and an equilibrium between the aforementioned greater force and the bias exerted by the spring elements. Thus a lower spring bias will result in a smaller area A, as will a stiff paper having a reduced propensity to deform. As an alternative, area A may be defined by a depression or countersink formed in the external surface of the drum about each passageway, as shown in dashed lines in FIG. 8.

In an alternative, non-illustrated embodiment of the invention, spring elements 74 may be arranged in an "over-centre" fashion so as to bias valve member 71 into one of an open or closed position depending on the proximity of the valve member to that position. Such a bistable valve arrangement is particularly useful at the edge of the material to be printed, where the partial actuation of a valve that might otherwise occur could give rise to imperfect retention.

FIGS. 9(*a*) and (*b*) are sectional views of another bistable valve arrangement that functions without spring elements and operates instead on differential pressure. That is to say, when the valve is proximate its closed position, it is biassed to the closed position by differential pressure and when it is proximate its open position, it is biassed to the open position by differential pressure. As with the embodiment of FIG. 6, a valve member 140 having collar 141 and shoulder 142 is arranged so as to be able to seal, more or less completely, with the edge of a hole 70 formed in drum wall 36. A vacuum is generated within the drum as indicated at 143. Unlike previous embodiments, however, the lower surface 144 of shoulder 142 is isolated from the vacuum—for example by outwardly extending sealing membrane 145—and exposed instead to atmospheric pressure supplied to the space 146 below, for example, via an inlet 147 formed in secondary drum skin 148 or via a bore 149 formed in collar 141. As a result, valve member 140 is urged into the closed position shown by a pressure difference acting over annular area A.

However, when valve member 140 is moved by the action of a sheet of paper 149 into the open position illustrated in FIG. 9(*b*), vacuum 143 is communicated to the depression 150 formed in the outer surface of the drum skin 36 around each hole 70. The area of depression 150 is chosen to be greater than that of the lower surface 144 by such an amount (shown as B) that the resultant force exerted by the ambient pressure acting on the opposite surface of the sheet to that exposed to the vacuum holds the valve member in the open position.

Without the need for spring elements and the corresponding fine tolerances that these may require, the embodiment described above may be easier to manufacture, particularly by moulding.

The printed sheet 79 may be stripped from the drum as previously described. However, it may in preference be stripped in accordance with a further embodiment of the invention shown in FIG. 10. In this embodiment, a strip roller 82 is mounted internally to, and in parallel with, the drum. The roller is withdrawable from contact with the drum to position 82' to prevent stripping when multiple pass printing is in operation.

In use, the strip roller 82 is urged against the interior of the drum when the sheet 79 is to be stripped therefrom. This causes the roller 82 to move the valves 71 into the closed position re-establishing seals 75. This isolates the vacuum from sheet 79 and also causes the bosses 76 to lift the sheet from the drum surface. The sheet then leaves the drum tangentially and is collected in an output tray (not shown).

While described in relation to the embodiment shown in FIGS. 6 and 7 it will be apparent that the strip roller of FIG. 10 may also be used with the embodiment shown in FIGS. 2 and 3 in place of, or in addition to, ejector 24/32.

With reference now to FIG. 11, there is disclosed an alternative and improved system for mounting the valves. Directly beneath the drum wall (not shown) there is disposed a flat sheet of a thin material which has been worked (for example, by electroforming, laser cutting, chemical milling or other means) to form a hexagonal matrix 90 to which valve bases 91 are integrally joined by three, spiral springs 94. (For clarity, only one set of springs has been illustrated.) The male valves (not shown) are moulded onto each such base. The matrix is joined to the drum wall at adhesion points 92. This system functions in the manner previously described. In an alternative form of manufacture the matrix, valve bases, spiral springs and valves may be formed by moulding (for example, by injection moulding) as a unitary assembly from an elastomer.

FIG. 12(*a*) shows an alternative design of male valve to that shown in FIG. 6. A collar 100 of conical cross-section having a conical axis orthogonal with the passageway axis, is provided and seals with an edge 101 of hole 70 formed in the drum wall 36. As shown in FIG. 12(*b*), the sealing surface 102 of the drum 36 can be profiled to match to conical face of the moving valve element 100—in the case where a valve does not seal perfectly due e.g. to manufacturing defects, where and tear, or random misalignment on closing of the valve, this latter arrangement will have a lower leakage flow rate (through the annular gap between sealing surface 102 and value member 100) than the arrangement of FIG. 12(*a*) where sealing takes place between sharp annular edge 101 and the valve member 100.

As with the embodiment of FIG. 11, it may be advantageous to form a plurality of valve arrangements of FIG. 12 as a unitary assembly. FIG. 13 is a sectional view of such an assembly formed by moulding in a resilient material such as an elastomer: valve element 100 is formed as part of an elastomeric sheet 113, which is attached to drum wall 36 by spacers 112 such that valve element 100 is urged into sealing contact with sealing surface 102 of drum skin 36.

In the region between spacers 112 and valve member 100, the elastomeric sheet preferably has the form of a conical shell. This provides a non-linear resistance to the inward displacement, d, of valve member 100 having the general characteristic illustrated in FIG. 14: the resistance F to movement when the valve is closed, as indicated at C, is significantly greater than at higher values of D corresponding to the valve being in the open position. This characteristic ensures good sealing when the valve is closed without significantly opposing the attachment of paper to the drum when the valve is open. It has been found that suitable resistance characteristics are obtained with a conical form having an angle 114 to the plane lying normal to the conical axis 115 in the range 15 to 45 degrees, an angle of 30 degrees having been found to provide the optimal characteristic. Movement of the valve member 100 between closed and open positions may be effected by the mechanisms described earlier with reference to FIGS. 10 and 11.

FIG. 15 is a section taken perpendicular to the axis 131 of a vacuum drum incorporating the valve element of FIG. 13. Elastomeric member 113 is advantageously secured to the spacers 112 of drum 36 by sprung cylindrical member 130 which is preferably split as indicated at 132, allowing it to be compressed (the state shown in FIG. 15) and removed from inside the drum. This in turn allows elastomeric member 113 to be removed for maintenance and/or replacement. Member 113 is further formed with holes 111 (FIG. 13) to permit the necessary communication between the surface of the drum skin 36 and the vacuum inside the drum, which may advantageously be generated by a pump located within the drum itself.

In a non-illustrated variant of FIG. 15, drum skin is itself formed as the sprung cylindrical member and is secured about a rigid inner cylinder, with the elastomeric member 113 being sandwiched between the two.

Each feature disclosed in this specification (which term includes the claims) and/or shown in the drawings may be incorporated in the invention dependently or other disclosed and/or illustrated features.

The text of the abstract filed herewith is repeated here as part of the specification.

A vacuum drum assembly for a printing machine comprises a drum having an array of passageways (40) distributed along its length and around its periphery to permit air to flow from outside the drum to inside the drum in response to reduced air pressure inside the drum, and an array of valve members (52), each valve member being movable between a closed position in which that valve member restricts at least one of the passageways and an open position in which the restriction of that passageway or those passageways is reduced. The arrangement is such that, when a partial area of the drum is wrapped with a sheet of material, at least some of the valves for the passageways adjacent the edges of the area are open, and the valves for the passageways which are not covered by the sheet and are not adjacent the edges of that area are closed. The open area of the drum is regulated such that it is small, or even zero, in regions where there is no paper. Accordingly, the open area of the drum is adapted to the shape and size of the paper and the position of the paper on the drum, while minimizing the required suction flow.

A duplex printing machine comprises two such vacuum drum assemblies with their drums parallel. The air pressure inside the drums is reduced and the drums are counter-rotated. Material to be printed on is fed to the first drum so that the material can be held on the first drum by vacuum and rotated therewith, and a first print head pints on one side of the material. The material is then released from the first drum in a direction towards the second drum so that the material can be held on the second drum by vacuum and rotated therewith. A second print head then prints on the material on the second drum. The material is then released from the second drum.

What is claimed is:

1. A vacuum drum assembly for a printing machine, the assembly comprising:

a drum having a length and a periphery with an array of passageways distributed along its length and around its periphery to permit air to flow from outside the drum to inside the drum in response to reduced air pressure inside the drum; and an array of valve members, each valve member being movable between a closed position in which that valve member restricts at least one of the passageways and an open position in which the restriction of the at least one passageway is reduced, and wherein a at least one of said valve members is normally closed and is opened by a pressure difference, wherein the assembly is arranged such that, when a partial area of the drum is covered with material to be printed, at least some of the valve members for the passageways adjacent an edge of said partial area are open, and the valve members for the passageways which are not covered by the material and are not adjacent an edge of said partial area are closed.

2. An assembly as claimed in claim 1 wherein the pressure difference that opens the at least one valve member is between adjacent passageways.

3. An assembly as claimed in claim 1 wherein each passageway is provided with a respective one of said valve members.

4. An assembly as claimed in claim 1 wherein each of the valve members affects an adjacent pair of the passageways.

5. An assembly as claimed in claim 1 further comprising:

wall portions between adjacent pairs of the passageways; and each valve member comprising a butterfly valve pivotally mounted on a respective one of the wall portions and biased towards its closed position.

6. An assembly as claimed in claim 5 wherein the wall portions are of energy-absorbing material and are connected to the butterfly valves to effect damping the movement of the valve members.

7. An assembly as claimed in claim 1 wherein each passageway has a circular, annular, elliptic or polygonal cross-section, and the passageways are distributed along the length and around the periphery of said drum.

8. An assembly as claimed in claim 1 wherein each passageway has a cross-section that is generally square.

9. An assembly as claimed in claim 1 further including means for damping the movement of the valve members.

10. An assembly according to claim 1 further including a printed material stripping means which is positioned within the drum and actuatable to be urged into contact with a drum wall thereby moving all contacted valve members from the open position to the closed position.

11. An assembly according to claim 10 wherein the printed material stripping means is mounted at a station where the leading edge of the printed material is required to be stripped.

12. A printing machine including a vacuum drum assembly as claimed in claim 1.

13. A machine as claimed in claim 12 further including, for the drum, means for holding or directing the material against or towards the drum at the position in which the material is fed onto the drum.

14. A duplex printing machine comprising:

first and second vacuum drum assemblies each as claimed in claim 1 and with the drums parallel;

means for reducing an air pressure inside the drums;

means for feeding material to be printed onto the first drum so that the material can be held on the first drum by vacuum and rotated therewith;

first printing means for printing on the material on the first drum;

means for releasing the material from the first drum in a direction towards the second drum so that the material can be held on the second drum by vacuum and rotated therewith;

second printing means for printing on the material on the second drum; and means for releasing the material from the second drum.

15. A machine as claimed in claim 14 further including, for each drum, means for holding or directing the material against or towards the respective drum at the position in which the material is fed onto the respective drum.

16. A machine as claimed in claim 14 wherein, the direction in which the material is released from the first drum towards the second drum is generally parallel to and opposite to the direction in which the material is fed onto the first drum, and the direction in which the material is released from the second drum is generally parallel to and opposite to the direction in which the material is fed onto the second drum.

17. A vacuum drum assembly for a printing machine, the assembly comprising:

a drum having a length and a periphery with an array of passageways distributed along its length and around its periphery to permit air to flow from outside the drum to inside the drum in response to reduced air pressure inside the drum, wherein the passageways extend through the periphery of the drum and terminate inside the drum; and an array of valve members arranged locally to said passageways, each valve member being movable between a closed position in which that valve member restricts at least one of the passageways and an open position in which the restriction of the at least one passageway is reduced, wherein the assembly is arranged such that, when a partial area of the drum is covered with material to be printed, at least some of the valve members for the passageways adjacent an edge of said partial area are open, and the valve members for the passageways which are not covered by the material and are not adjacent an edge of said partial area are closed.

18. An assembly as claimed in claim 17 wherein at least one valve member is normally closed and is opened by a pressure difference.

19. An assembly as claimed in claim 17 wherein at least one valve member is opened by a pressure difference between adjacent passageways.

20. An assembly as claimed in claim 17 wherein each passageway (40) is provided with a respective one of said valve members (48).

21. An assembly as claimed in claim 17 wherein each of the valve members affects an adjacent pair of the passageways.

22. An assembly as claimed in claim 17 further comprising:

wall portions between adjacent pairs of the passageways; and each valve member comprising a butterfly valve pivotally mounted on a respective one of the wall portions and biased towards its closed position.

23. An assembly as claimed in claim 22 wherein the wall portions are of energy-absorbing material and are connected to the butterfly valves to effect damping the movement of the valve members.

24. An assembly as claimed in claim 17 wherein each passageway has a circular, annular, elliptic or polygonal cross-section, and the passageways are distributed along the length and around the periphery of said drum.

25. An assembly as claimed in claim 17 wherein each passageway has a cross-section that is generally square.

26. An assembly as claimed in claim 17 wherein at least one valve member is opened by mechanical actuation.

27. An assembly according to claim 26 wherein the at least one valve member comprises an actuating means which moves the at least one valve member to the open position on mechanical contact with the material to be printed.

28. An assembly according to claim 27 wherein the actuating means comprises a portion of the at least one valve member which is housed within the passageway and is dimensioned to project from the drum when the at least one valve member is in the closed position.

29. An assembly according to claim 27 wherein the at least one valve member is biased so that on removal of the material it moves back to the closed position.

30. An assembly according to claim 29 wherein the at least one valve member is bistable being biased towards closed when proximate the closed position and also biased towards open when proximate the open position.

31. An assembly according to claim 29 further including means for applying to the at least one valve member a non-linear closing force that is greater when the at least one valve member is proximate the closed position than when proximate the open position.

32. An assembly according to claim 30 further including spring elements arranged in an over-centre fashion, thereby to bias said at least one valve member into one of an open or closed position depending on a proximity of the at least one valve member to that position.

33. An assembly according to claim 30 wherein a first area of said at least one valve member is subject to the reduced air pressure so as to urge said at least one valve member into its closed position when proximate that closed position, and wherein a second area of said material to be printed is subject to the reduced air pressure so as to urge said at least one valve member into its open position when proximate that open position.

34. An assembly according to claim 33 wherein said second area is greater than said first area.

35. An assembly according to claim 34 wherein the at least one valve member has a boss on a first surface for mechanically contacting said material to be printed and wherein a second surface opposing said first surface communicates with atmospheric pressure.

36. An assembly according to claim 35 wherein said first surface is engageable with the periphery of an associated passageway formed in said drum, thereby to restrict said passageway.

37. An assembly according to claim 36 wherein said at least one valve member is formed with a bore providing communication between a surfaced said boss and said second surface.

38. An assembly according to claim 31 wherein said means for applying a non-linear closing force comprises a conical shell of resilient material.

39. An assembly according to claim 38 wherein the conical shell defines an angle to the plane lying normal to the a conical axis wherein the angle is in the range of about 15 to about 45 degrees.

40. An assembly according to claim 39 wherein the angle is about 30 degrees.

41. An assembly according to claim 38 wherein said at least one valve member has sealing means for sealing with a respective passageway in the drum, the sealing means being integral with said conical shell.

42. An assembly according to claim 26 wherein a biasing means generates a force on the at least one valve member when open that is less than that force generated as a result of the reduced air pressure acting on the material to printed.

43. An assembly according to claim 42 wherein a depression or counter-sink is formed in a surface of the drum around each passageway.

44. An assembly according to claim 26 where said at least one valve member has a conical surface for sealing with a corresponding conical surface of the drum.

45. An assembly according to claim 26 wherein a plurality of valve members are formed in a matrix, the matrix engaging an inner surface of said vacuum drum.

46. An assembly according to claim 45 wherein the matrix is resiliently urged against the inner surface of said vacuum drum by retaining means located within the drum.

47. An assembly according to claim 45 wherein the drum is resiliently urged against said matrix by retaining means.

48. An assembly as claimed in claim 17 including means for damping the movement of the valve members.

49. An assembly according to claim 17 including printed material stripping means which is positioned within the drum and actuatable to be urged into contact with a drum wall thereby moving all contacted valve members from the open position to the closed position.

50. An assembly according to claim 49 wherein the printed material stripping means is mounted at a station where the leading edge of the printed material is required to be stripped.

51. A printing machine including a vacuum drum assembly as claimed in claim 17.

52. A machine as claimed in claim 51 further including, for the drum, means for holding or directing the material against or towards the drum at the position in which the material is fed onto the drum.

53. A duplex printing machine comprising:

first and second vacuum drum assemblies each as claimed in claim 17 and with the drums parallel;

means for reducing the air pressure inside the drums;

means for feeding material to be printed onto the first drum so that the material can be held on the first drum by vacuum and rotated therewith;

first printing means for printing on the material on the first drum;

means for releasing the material from the first drum in a direction towards the second drum so that the material can be held on the second drum by vacuum and rotated therewith;

second printing means for printing on the material on the second drum; and means for releasing the material from the second drum.

54. A machine as claimed in claim 53 further including, for each drum, means for holding or directing the material against or towards the respective drum at the position in which the material is fed onto the respective drum.

55. A machine as claimed in claim 53 wherein, the direction in which the material is released from the first drum towards the second drum is generally parallel to and opposite to the direction in which the material is fed onto the first drum, and the direction in which the material is released from the second drum is generally parallel to and opposite to the direction in which the material is fed onto the second drum.

56. A vacuum drum assembly for a printing machine, comprising:

a drum having a length and periphery with an array of passageways distributed along its length and around its periphery to permit air to flow from outside the drum to inside the drum in response to reduced air pressure inside the drum, wherein the passageways extend through the periphery of the drum and terminate inside the drum; and an array of valve members distributed along its length and around its periphery, each valve member being movable between a closed position in which that valve member restricts at least one of the passageways and an open position in which the restriction of the at least one passageway is reduced, wherein the assembly is arranged such that, when a partial area of the drum is covered with material to be printed, at least some of the valve members for the passageways adjacent an edge of said partial area are open, and the valve members for the passageways which are not covered by the material and are not adjacent an edge of said partial area are closed.

57. An assembly as claimed in claim 56 wherein at least one of said valve members is normally closed and is opened by a pressure difference.

58. An assembly as claimed in claim 56 wherein at least one of said valve members is opened by a pressure difference between adjacent passageways.

59. An assembly as claimed in claim 56 wherein each passageway is provided with a respective one of said valve members.

60. An assembly as claimed in claim 56 wherein each of the valve members affects an adjacent pair of the passageways.

61. An assembly as claimed in claim 56 further comprising:

wall portions between adjacent pairs of the passageways; and each valve member comprising a butterfly valve pivotally mounted on a respective one of the wall portions and biased towards its closed position.

62. An assembly as claimed in claim 61 wherein the wall portions are of energy-absorbing material and are connected to the butterfly valves to effect damping the movement of the valve members.

63. An assembly as claimed in claim 56 wherein each passageway has a circular, annular, elliptic or polygonal cross-section, and the passageways are distributed along the length and around the periphery of said drum.

64. An assembly as claimed in claim 56 wherein each passageway has a cross-section that is generally square.

65. An assembly as claimed in claim 56 wherein at least one of said valve members is opened by mechanical actuation.

66. An assembly according to claim 65 wherein the at least one valve member comprises an actuating means which moves the at least one valve member to the open position on mechanical contact with the material to be printed.

67. An assembly according to claim 66 wherein the actuating means comprises a portion of the at least one valve member which is housed within the passageway and is dimensioned to project from the drum when the at least one valve member is in the closed position.

68. An assembly according to claim 66 wherein the at least one valve member is biased so that on removal of the material it moves back to the closed position.

69. An assembly according to claim 68 wherein the at least one valve member is bistable being biased towards closed when proximate the closed position and also biased towards open when proximate the open position.

70. An assembly according to claim 68 further including means for applying to the at least one valve member a non-linear closing force that is greater when the at least one valve member is proximate the closed position than when proximate the open position.

71. An assembly according to claim 70 wherein said means for applying a non-linear closing force comprises a conical shell of resilient material.

72. An assembly according to claim 71 wherein the conical shell defines an angle to the plane lying normal to the a conical axis wherein the angle is in the range of about 15 to about 45 degrees.

73. An assembly according to claim 72 wherein the angle is about 30 degrees.

74. An assembly according to claim 71 wherein said at least one valve member has sealing means for sealing with a respective passageway in the drum, the sealing means being integral with said conical shell.

75. An assembly according to claim 69 further including spring elements arranged in an over-centre fashion, thereby to bias said at least one valve member into one of an open or closed position depending on a proximity of the at least one valve member to that position.

76. An assembly according to claim 69 wherein a first area of said at least one valve member is subject to the reduced air pressure so as to urge said at least one valve member into its closed position when proximate that closed position, and wherein a second area of said material to be printed is subject to the reduced air pressure so as to urge said at least one valve member into its open position when proximate that open position.

77. An assembly according to claim 76 wherein said second area is greater than said first area.

78. An assembly according to claim 77 wherein the at least one valve member has a boss on a first surface for mechanically contacting said material to be printed and wherein a second surface opposing said first surface communicates with atmospheric pressure.

79. An assembly according to claim 78 wherein said first surface is engageable with the periphery of an associated passageway formed in said drum, thereby to restrict said passageway.

80. An assembly according to claim 78 wherein said at least one valve member is formed with a bore providing communication between a surface of said boss and said second surface.

81. An assembly according to claim 65 wherein a biasing means generates a force on the at least one valve member when open that is less than that force generated as a result of the reduced air pressure acting on the material to printed.

82. An assembly according to claim 81 wherein a depression or counter-sink is formed in a surface of the drum around each passageway.

83. An assembly according to claim 65 where said at least one valve member has a conical surface for sealing with a corresponding conical surface of the drum.

84. An assembly according to claim 65 wherein a plurality of valve members are formed in a matrix, the matrix engaging an inner surface of said vacuum drum.

85. An assembly according to claim 84 wherein the matrix is resiliently urged against the inner surface of said vacuum drum by retaining means located within the drum.

86. An assembly according to claim 85 wherein the drum is resiliently urged against said matrix by retaining means.

87. An assembly as claimed in claim 56 including means for damping the movement of the valve members.

88. An assembly according to claim 56 including printed material stripping means which is positioned within the drum and actuatable to be urged into contact with a drum wall thereby moving all contacted valve members from the open position to the closed position.

89. An assembly according to claim 88, wherein the printed material stripping means is mounted at a station where the leading edge of the printed material is required to be stripped.

90. A printing machine including a vacuum drum assembly as claimed in claim 56.

91. A duplex printing machine comprising:

first and second vacuum drum assemblies each as claimed in claim 56 and with the drums parallel;

means for reducing the air pressure inside the drums;

means for feeding material to be printed onto the first drum so that the material can be held on the first drum by vacuum and rotated therewith;

first printing means for printing on the material on the first drum;

means for releasing the material from the first drum in a direction towards the second drum so that the material can be held on the second drum by vacuum and rotated therewith;

second printing means for printing on the material on the second drum; and means for releasing the material from the second drum.

92. A machine as claimed in claim 91 further including, for the drum, means for holding or directing the material against or towards the drum at the position in which the material is fed onto the drum.

93. A machine as claimed in claim 91 further including, for each drum, means for holding or directing the material against or towards the respective drum at the position in which the material is fed onto the respective drum.

94. A machine as claimed in claim 91 wherein, the direction in which the material is released from the first drum towards the second drum is generally parallel to and opposite to the direction in which the material is fed onto the first drum, and the direction in which the material is released from the second drum is generally parallel to and opposite to the direction in which the material is fed onto the second drum.

* * * * *

UNITED STATES PATENT AND TRADEMARK OFFICE

CERTIFICATE OF CORRECTION

PATENT NO. : 6,682,191 B2
DATED : January 27, 2004
INVENTOR(S) : Stephen Temple et al.

It is certified that error appears in the above-identified patent and that said Letters Patent is hereby corrected as shown below:

Column 11,
Line 38, delete “a at least one” and insert -- at least one --.

Column 14,
Line 19, delete “a surface said boss” and insert -- a surface of said boss --.
Lines 24-25, delete “to the a” and insert -- to a --.
Line 36, delete “to printed.” and insert -- to be printed. --.

Column 16,
Lines 44-45, delete “to the a” and insert -- to a --.

Signed and Sealed this

Twenty-second Day of February, 2005

JON W. DUDAS
*Director of the United States Patent and Trademark Office*